United States Patent [19]

Geddie

[11] Patent Number: 4,681,244

[45] Date of Patent: Jul. 21, 1987

[54] PORTABLE BAR

[76] Inventor: John D. Geddie, 832 Walnut St., Charlotte, Mich. 48813

[21] Appl. No.: 857,264

[22] Filed: Apr. 30, 1986

[51] Int. Cl.[4] ..... B67D 1/00

[52] U.S. Cl. ..... 222/144.5; 222/145; 222/175; 248/148; 248/181; D2/248

[58] Field of Search ..... 222/175, 144.5, 145, 222/132, 129.1; 224/148, 181; 137/606, 607; D2/248, 246; D7/70, 71, 301, 305; 2/183

[56] References Cited

U.S. PATENT DOCUMENTS

| | | | |
|---|---|---|---|
| D. 283,268 | 4/1986 | Rebiskie et al. | 224/181 X |
| 494,061 | 3/1893 | Day | 222/145 X |
| 1,879,269 | 9/1932 | Hutchinson | 222/145 |
| 2,120,865 | 6/1938 | Kleman | 222/145 X |
| 4,191,183 | 3/1980 | Mendelson | 222/145 X |
| 4,439,871 | 4/1984 | Plastino | 2/183 X |
| 4,544,087 | 10/1985 | Modig | 224/148 |
| 4,607,755 | 8/1986 | Andreozzi | 224/148 X |

*Primary Examiner*—Joseph J. Rolla
*Assistant Examiner*—Nils Pedersen
*Attorney, Agent, or Firm*—John H. Calhoun, Jr.

[57] ABSTRACT

A portable mix bar comprising a hard hat having a plurality of drink containers and a pair of mixing chambers for mixing drinks mounted thereon wherein the flow of drinks to and from the mixing chambers is controlled by a plurality of valves. Also provided is a plurality of tubes for carrying drinks from the drink containers to the valves and mixing chambers and between valves and mixing chambers and from the mixing chambers to the mouth of a user.

2 Claims, 3 Drawing Figures

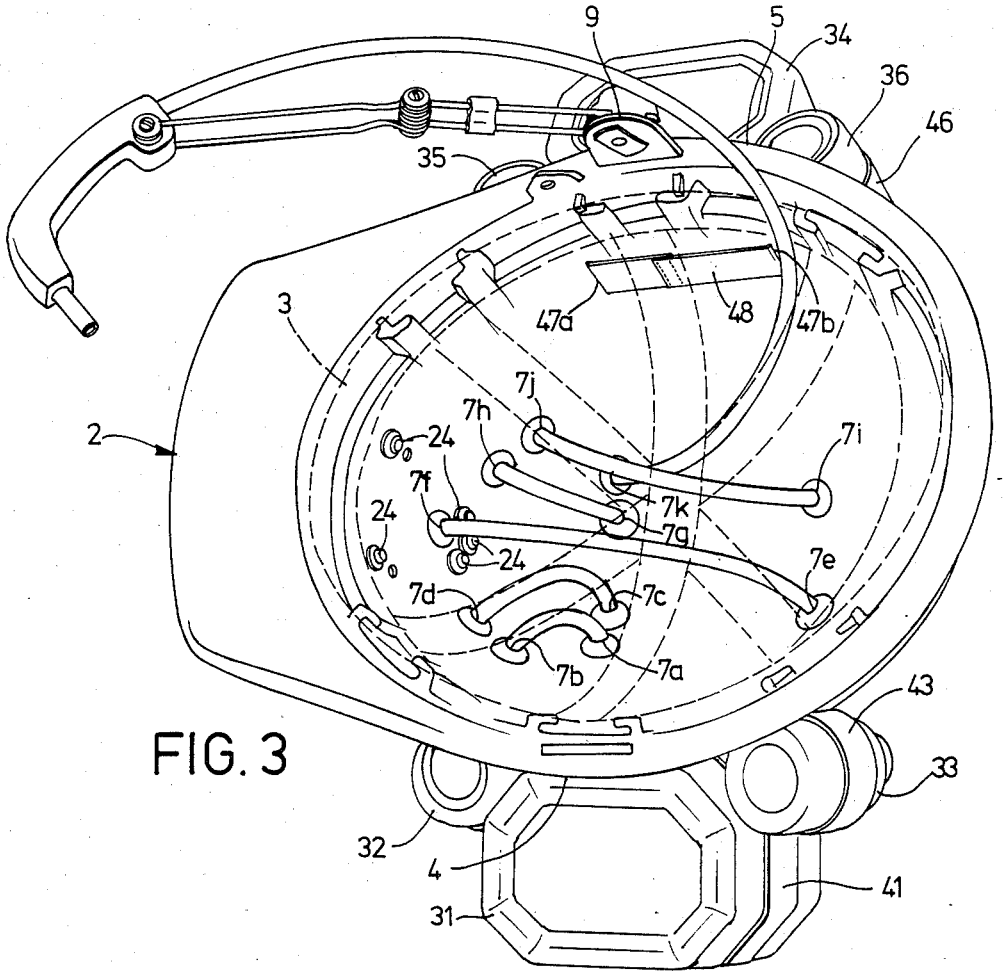
FIG. 3
FIG. 2
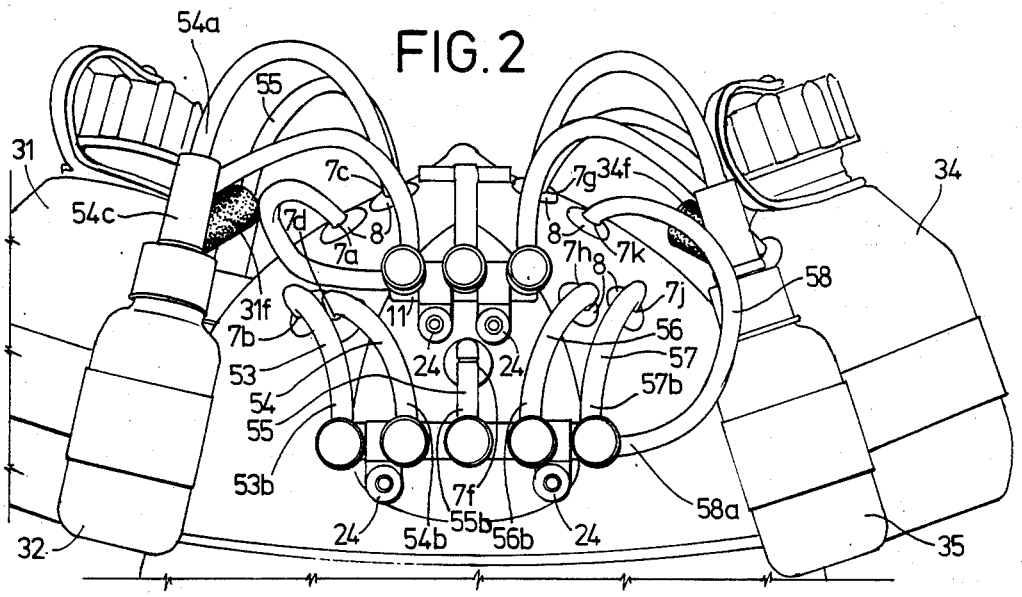

PORTABLE BAR

BACKGROUND OF THE INVENTION

The present invention relates to an improved portable bar, that is a portable device that is used for mixing cocktails or the like. The portable bar of the present invention is adapted to be worn by a person as a hat and is intended to be both useful and entertaining.

Novelty hats are known in the prior art as illustrated by U.S. Pat. No. 4,484,363 issued to Teresa E. Varanese on Nov. 27, 1984 for a combination hat and cooling device; U.S. Pat. No. 3,345,646 issued to C. P. McCann on Oct. 10, 1967 for a parachute hat; U.S. Pat. No. 3,254,444 issued to G. Paterson on June 7, 1966 for an amusement and educational head gear; U.S. Pat. No. 2,611,902 issued to M. F. Rockmore on Sept. 30, 1952 for a novelty cap; U.S. Pat. No. 2,136,925 issued to N. P. Ristell, et al. on Nov. 15, 1938 for a combined beach hat and fan; U.S. Pat. No. 1,869,652 issued to H. H. Baker on Aug. 2, 1932 for a kit hat; U.S. Pat. No. 1,493,463 issued to P. P. Brock on May 13, 1924 for a lamp holder; and U.S. Pat. No. 21,485 issued to Joseph C. Cary on Sept. 14, 1858 for a combined cap and lantern.

The present invention provides a novel and useful portable bar that can be worn as a hat and which is both useful and entertaining.

SUMMARY OF THE INVENTION

The portable bar of the present invention provides several distinct and important advantages not found in previously known mix bars or hats.

A primary objective of the present invention is to provide a portable bar that may be worn as a piece of head gear.

Another objective of the present invention is to provide a portable bar having a structural member that also serves as a hat and that may be adjusted to fit different size heads.

Another objective of the present invention is to provide a portable bar that may be used for conveniently consuming any of several drinks that may be kept in a plurality of drink containers comprising part of the portable bar.

Another object of the present invention is to provide a portable bar that may be conveniently used to mix drinks from two or more containers to form a mixed drink.

Another objective of the present invention is to provide a portable bar from which drinks may be sipped without removing the bar from the user's head.

Another objective of the present invention is to provide a portable bar that is novel in appearance and entertaining.

Another object of the present invention is to provide a portable bar that is simple in construction, inexpensive, strong and durable, convenient to use, and well adapted for its intended purposes.

Other objects and advantages of the present invention will become apparent from a consideration of the following detailed description taken in connection with the accompanying drawings wherein a preferred embodiment of the invention is shown.

It should be understood that the invention is not limited to the details disclosed, but includes all such variations and modifications as fall within the spirit of the invention and the scope of the appended claims.

This invention contemplates portable bars of different sizes for use with different size heads and portable bars having different numbers, sizes or types of drink containers.

The objectives of the present invention are accomplished by providing a rigid hat that may be adjusted to fit different size heads such, for example, as a safety helmet or hard hat with an adjustable head band provided therein. Several drink containers are mounted on the sides of the hat using elastic bands that are inserted through slots in the hat and fastened to the inside of the hat. In the illustrated embodiment there are six such containers, including two relatively large containers that might be used for soft drinks such, for example, as soda or ginger ale. The other four containers are relatively smaller and might be used to hold one or more alcoholic beverages. Each drink container is provided with a tube for carrying liquid from the container to one of two gang valves on the front of the hat that may be used for mixing drinks from two or more drink containers. Alternatively, a user of the portable bar may drink from any one container by opening the valve controlling the flow of liquid from that container and closing the valves that control the flow of liquid from all of the other drink containers.

The first gang valve comprises three valves that are used for controlling the flow of soft drinks from two soft drink containers and for purging the mixing chambers and outlet tube. The second gang comprises five valves, and is used to mix the soft drink or soft drink mix received from the first gang valve with the contents of any of the other four drink containers. An outlet tube carries the resulting mix from an outlet port on the second gang valve to the mouth of the wearer of the hat, who may drink mixed drinks from the bar by sucking on the free end of the outlet tube in the same manner as a person sucks on a sipping straw to draw liquid from a bottle or glass.

Each drink container is provided with a vent for venting carbon dioxide gas in any case were a carbonated drink is being kept in a containers and to maintain atmospheric pressure in the containers in all cases. The four smaller drink containers are provided with check valves in their respective tubes to prevent liquids from flowing backwards into the containers.

An articulated boom supports the outlet tube that carries the mixed drink from the portable bar to the user's mouth.

BRIEF DESCRIPTION OF THE DRAWINGS

A preferred embodiment of the present invention is illustrated in the accompanying drawings in which:

FIG. 2 is a front elevation view of the portable bar of the present invention and FIG. 3 is a bottom view in perspective of the portable bar of the present invention.

DESCRIPTION OF THE PREFERRED EMBODIMENT

Figure 1:
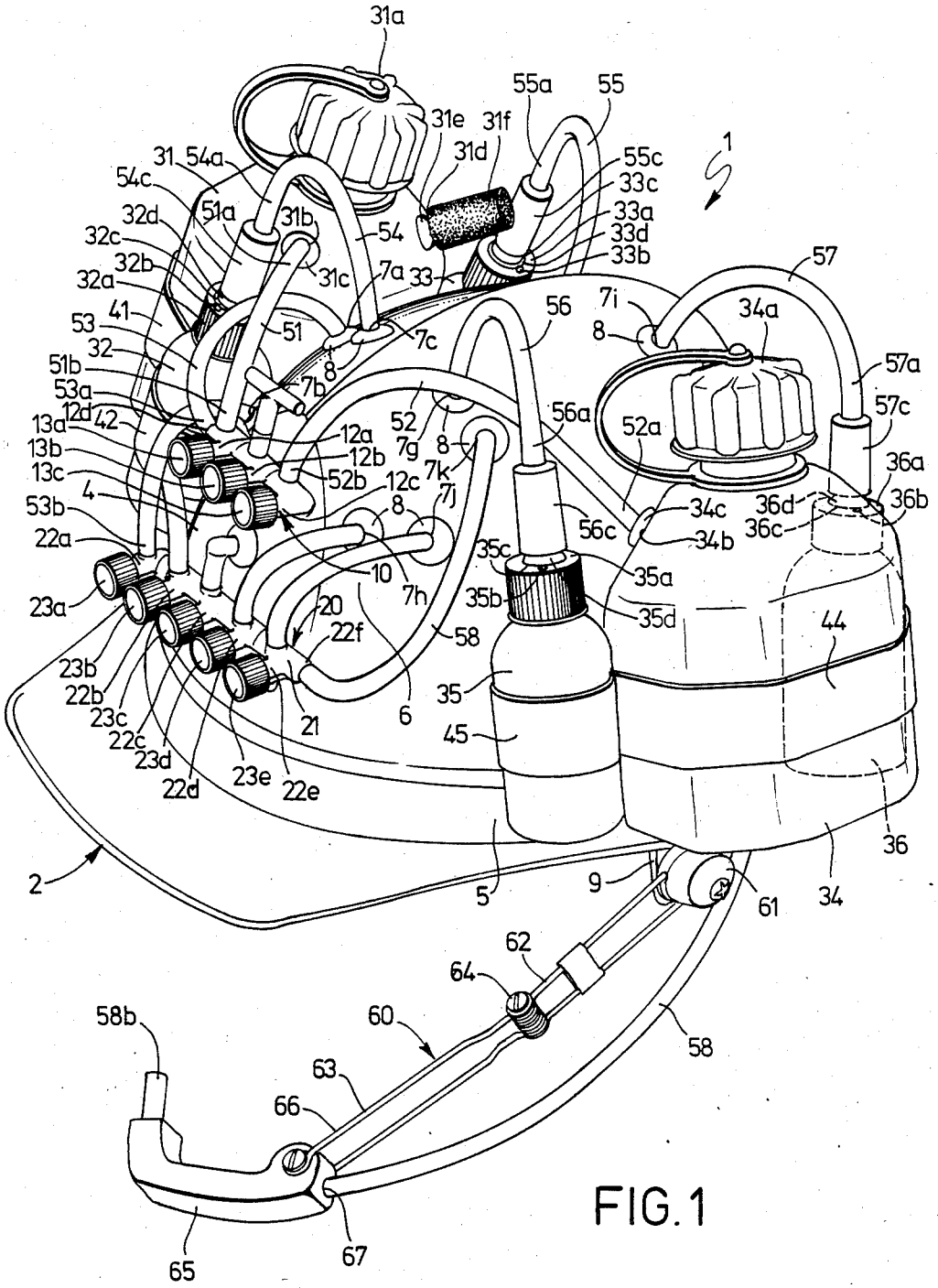
FIG. 1 is a side view in perspective of the portable bar of the present invention.

Referring now to the drawings in greater detail, FIGS. 1–3 illustrate the portable bar of the present invention shown generally at 1. The bar 1 comprises a structural member 2, and in the illustrated embodiment the structural member 2 comprises a rigid hat-shaped device adapted to fit on the head of a person such, for example, as a safety hat, sometimes referred to as a hard hat.

As shown in FIG. 3, the hat 2 is provided on the inside thereof with a plurality of head bands 3 that are adapted to be adjusted to fit the hat 2 to heads of different sizes.

The hat 2 is adapted to receive a plurality of liquid containers 31, 32, 33, 34, 35, 36 detachably coupled by suitable attachment means 41, 42, 43, 44, 45, 46 to a first side 4 and a second side 5 of the hat 2. The hat 2 is provided with a plurality of holes 7a, 7b, 7c, 7d, 7e, 7f, 7g, 7h, 7i, 7j, 7k therethrough. Each hole 7a–7k is adapted to receive a tube inserted therethrough and is provided with a protective grommet 8 inserted therein.

Detachably coupled to the front 6 of the hat 2 by suitable attachment means 24 is a first gang valve 10. The first gang valve 10 comprises a first mixing chamber 11 having attached thereto and extending therefrom a first port 12a, a second port 12b, a third port 12c and a fourth port 12d wherein the first, second and third ports 12a–12c are each provided with a valve having an external knob 13a, 13b, 13c for controlling the valve. Each port 12a–12d communicates with the first mixing chamber 11 and is adapted to convey a liquid into or out of the first mixing chamber 11, and each port 12a–12d is adapted to receive a tube detachably coupled thereto.

Also detachably coupled to the front 6 of the hat 2 by suitable attachment means 24 is a second gang valve 20. The second gang valve 20 comprises a second mixing chamber 21 having attached thereto and extending therefrom a fifth port 22a, a sixth port 22b, a seventh port 22c, an eighth port 22d, a ninth port 22e and a tenth port 22f wherein the fifth, sixth, seventh, eighth and ninth ports 22a–22e are each provided with a valve having an external knob 23a, 23b, 23c, 23d, 23e for controlling the valve. Each port 22a–22f communicates with the second mixing chamber 21 and is adapted to convey a liquid into or out of the second mixing chamber 21, and each port 22a–22f is adapted to receive a tube detachably coupled thereto.

Gang valves of the kind used in the present invention are well known in the prior art and may be conveniently purchased.

Each liquid container 31–36 is detachably coupled to the hat 2 by suitable attachment means, and in the illustrated embodiment the said attachment means comprises a plurality of elastic straps 41, 42, 43, 44, 45, 46, each of which encircles a container 31, 32, 33, 34, 35, 36. The two ends of each strap 41, 42, 43, 44, 45, 46 are inserted through a slot 47a, 47b in the hat 2 and are fastened together inside the hat 2 at 48 so that they will not slip back through the slots 47a, 47b.

Each liquid container 31–36 is provided with a removable cap 31a–36a for opening and closing the container 31–36.

In the illustrated embodiment the first and fourth liquid containers 31, 34 are alike and are relatively larger than the other liquid containers 32, 33, 35, 36. Each of the larger liquid containers 31, 34 is provided with a removable cap 31a, 34a for opening and closing the container 31, 34. Each of the larger containers 31, 34 is also provided with a hole 31b, 34b therethrough having a grommet 31c, 34c inserted therein, and the holes 31b, 34b are adapted to receive tubes inserted therethrough and into the containers 31, 34. Each of the larger containers 31, 34 is provided with a second hole 31d having a grommet 31e, inserted therein and having a vent 31f inserted therein and extending therefrom, which vent 31f is adapted to vent the container 31, 34 to the atmosphere.

In the illustrated embodiment the second, third, fifth and sixth liquid containers 32, 33, 35, 36 are alike and are relatively smaller than the other liquid containers 31, 34. The removable caps 32a, 33a, 35a, 36a of the smaller containers 32, 33, 35, 36 are each provided with a small hole 32b, 33b, 35b, 36b therethrough for venting the containers 32, 33, 35, 36 to the atmosphere. Each of the said caps 32a, 33a, 35a, 36a is also provided with a larger hole 32c, 33c, 35c, 36c therethrough, each of which has a grommet 32d, 33d, 35d, 36d inserted therein and each of which is adapted to receive a tube inserted therethrough and into the container 32, 33, 35, 36.

In the illustrated embodiment a large container 31, 34 and two smaller containers 32, 33, 35, 36 are mounted on each side 4, 5 of the hat 2.

Also provides is a plurality of conduit means 51, 52, 53, 54, 55, 56, 57, 58 adapted to convey drinks from the plurality of drink containers 31–36 to the first and second gang valves 10, 20 and from the first gang valve 10 to the second gang valve 20 and from the second gang valve 20 to the mouth of a wearer of the hat 2. In the illustrated embodiment, each conduit means comprises a flexible tube 51, 52, 53, 54, 55, 56, 57, 58, each tube 51–58 having two ends. Each tube is adapted to serve as a suction tube for sucking liquid out of a liquid container 31–36 and into or out of a gang valve 10, 20 in a manner similar to that commonly used with sipping straws to suck drinks out of bottles or glasses. The fourth, fifth, sixth and seventh tubes 54–57 are each provided with a check valve 54c, 55c, 56c, 57c inserted therein, and adapted to prevent liquids from flowing backward in the tubes 54–57.

The first end 51a of the first tube 51 is inserted into the first liquid container 31 through the hole 31b provided therefor, and the other end 51b of the first tube 51 is detachably coupled to the first port 12a of the first gang valve 10.

The first end 52a of the second tube 52 is inserted into the fourth liquid container 34 through the hole 34b provided therefor, and the other end 52b of the second tube 52 is detachably coupled to the third port 12c of the first gang valve 10.

The first end 53a of the third tube 53 is detachably coupled to the fourth port 12d of the first gang valve 10 and the tube is routed into the hat 2 through a first hole 7a in the hat 2, through the inside of the hat 2, and out of the hat 2 through a second hole 7b in the hat 2, and the other end 53b of the third tube 53 is detachably coupled to the fifth port 22a on the second gang valve 20.

The first end 54a of the fourth tube 54 is inserted into the second liquid container 32 through the hole 32c in the cap 32a provided therefor. The tube 54 is routed into the hat 2 through a third hole 7c in the hat 2, through the inside of the hat 2, and out of the hat 2 through a fourth hole 7d in the hat 2. The other end 54b of the fourth tube 54 is detachably coupled to the sixth port 22b on the second gang valve 20.

The first end 55a of the fifth tube 55 is inserted into the third liquid container 33 through the hole 33c in the cap 33a provided therefor. The tube 55 is routed into the hat 2 through a fifth hole 7e in the hat 2, through the inside of the hat 2, and out of the hat 2 through a sixth hole 7f in the hat 2. The other end 55b of the fifth tube 55 is detachably coupled to the seventh port 22c on the second gang valve 20.

The first end 56*a* of the sixth tube 56 is inserted into the fifth liquid container 35 through the hole 35*c* in the cap 35*a* provided therefor. The tube 56 is routed into the hat 2 through a seventh hole 7*g* in the hat 2, through the inside of the hat 2, and out of the hat 2 through an eighth hole 7*h* in the hat 2. The other end 56*b* of the sixth tube 56 is detachably coupled to the eighth port 22*d* on the second gang valve 20.

The first end 57*a* of the seventh tube 57 is inserted into the sixth liquid container 36 through the hole 36*c* in the cap 36*a* provided therefor. The tube 57 is routed into the hat 2 through a ninth hole 7*i* in the hat 2, through the inside of the hat 2, and out of the hat 2 through an tenth hole 7*j* in the hat 2. The other end 57*b* of the sixth tube 57 is detachably coupled to the ninth port 22*e* on the second gang valve 20.

The first end 58*a* of an eighth tube 58 is detachably coupled to the tenth port 22*f* on the second gang valve 20, and the tube 58 is routed into the hat 2 through an eleventh hole 7*k* in the hat 2, and the eighth tube 58 extends around the side of the hat 2 and the other end 58*b* of the eighth tube is located in the front 6 of the hat 2 where it may be conveniently placed in the mouth of a wearer of the hat.

A bracket 9 is attached to and depends from one side 5 of the hat 2. An articulated boom 60 is pivotally coupled to the bracket 9 at 61, the pivoted coupling 61 being adapted for rotation of the distal end 66 of the boom 60 upward or downward relative to the front 6 of the hat 2.

The boom 60 comprises a first section 62 and a second section 63 that are pivotally joined end-to-end at 64. The pivoted coupling 64 is adapted for rotating the distal end 66 of the boom 60 in and out relative to the front 6 of the hat 2.

A mouth piece support member 65 is provided at the distal end 66 of the second section 63 of the articulated boom 60. The mouth piece support 65 is provided with a hole 67 lengthwise therethrough, and the eighth tube 58 is inserted through the said hole 67 and is held in and supported by the mouth piece support 65 so that the free end 58*b* of the eighth tube 58 is positioned so that it may be conveniently inserted into the mouth of a person wearing the hat and may be used to suck mixed drinks from the portable bar 1.

In the illustrated embodiment the second port 12*b* on the first gang valve 10 does not receive liquid from a drink container, but opens to the atmosphere.

A user of the portable bar of the present invention may fill the two larger drink containers with soft drinks such, for example, as ginger ale or soda. The four smaller drink containers may be filled with various kinds of alcoholic beverages.

To drink from the first soft drink container only, a user would open the valves in the first and fourth ports 12*a*, 12*d* on the first gang valve 10 and the fifth and tenth ports 22*a*, 22*f* on the second gang valve 20 and suck on the free end 58*b* of the eighth tube 58. Soft drink from the first drink container 31 would flow out of the container 31, through the first tube 51, into the first port 12*a* and the first mixing chamber 11 of the first gang valve 10, out of the fourth port 12*d* of the first gang valve, through the third tube 53 into and out of the hat 2 and into the fifth port 22*a* and second mixing chamber 21 of the second gang valve 20, our of the tenth port 22*f* of the second gang valve 20, and through the eighth tube 58 to the user's mouth.

To switch to drinking from the second soft drink container only, the user would close the valve in the first port 12*a* on the first gang valve 10 and open the valve in the third port 12*c* on the first gang valve 10. To drink from both soft drink containers simultaneously, ie. mix the two soft drinks, a user would open the valves in both the first and third ports 12*a*, 12*c* in the first gang valve 10. To purge the lines and mixing chambers of soft drinks, a user would close the first and third ports 12*a*, 12*c* and open the second port 12*b* on the first gang valve 10, and suck any remaining soft drink from the tubes and mixing chambers. The flow of soft drinks may be completely inhibited by closing the valves in the first and third ports 12*a*, 12*c* in the first gang valve 10, or by closing the fourth port 12*d* in the first gang valve 10, or by closing the fifth port 22*a* in the second gang valve 20.

A user might drink an alcoholic beverage from any one of the four containers holding such beverages by inhibiting the flow of soft drinks in the manner just described, and by opening the valve in the tenth port 22*f* on the second gang valve 20 and the valve in either the sixth, seventh, eighth, or ninth port 22*b*, 22*c*, 22*d*, 22*e* on the second gang valve 20. It can now be easily seen that alcoholic beverages from two or more containers may mixed together and soft drinks may be added to alcoholic beverages by opening and closing various combinations of valves.

The rate of flow of various liquids from their containers is controlled by adjusting the valves in the usual way, thus determining the exact composition of the final mixed drink.

Having thus described my invention, what I now claim is:

1. A portable bar comprising a hat adapted to receive a plurality of drink containers and a plurality of valves detachably mounted thereon; a first drink container coupled to the hat by suitable attachment means and having provided thereon a cap adapted for closing the said container, the said container being adapted to receive a tube inserted therein; a second drink container coupled to the hat by suitable attachment means and having provided thereon a cap adapted for closing the said container, the said container being adapted to receive a tube inserted therein; a third drink container coupled to the hat by suitable attachment means and having provided thereon a cap adapted for closing the said container, the said cap being adapted to receive a tube inserted therethrough; a fourth drink container coupled to the hat by suitable attachment means and having provided thereon a cap adapted for closing the said container, the said cap being adapted to receive a tube inserted therethrough; a fifth drink container coupled to the hat by suitable attachment means and having provided thereon a cap adapted for closing the said container, the said cap being adapted to receive a tube inserted therethrough; a sixth drink container coupled to the hat by suitable attachment means and having provided thereon a cap adapted for closing the said container, the said cap being adapted to receive a tube inserted therethrough; a first gang valve coupled to the hat by suitable attachment means, the said gang valve having a first mixing chamber, the said first mixing chamber having extending therefrom a first port, a second port, a third port, and a fourth port wherein the first port is provided with a first valve adapted to be controlled by a knob and the said second port is provided with a second valve adapted to be controlled by a knob and the said third port is provided with a third valve adapted to be controlled by a knob, and wherein each of the said ports communicates with the said first mixing chamber and is adapted to convey a drink into or out of the said first mixing chamber and wherein the said first, third and fourth ports is each adapted to receive a tube detachably coupled thereto, and wherein the said second port is adapted to vent the said first mixing chamber to the atmosphere; a second gang valve coupled to the hat by suitable attachment means, the said gang valve having a second mixing chamber, the said second mixing chamber having extending therefrom a fifth port, a sixth port, a seventh port, an eighth port, a ninth port and a tenth port wherein the said fifth port is provided with a fourth valve adapted to be controlled by a knob and the said sixth port is provided with a fifth valve adapted to be controlled by a knob and the said seventh port is provided with a sixth valve adapted to be controlled by a knob and the said eighth port is provided with a seventh valve adapted to be controlled by a knob and the said ninth port is provided with an eighth valve adapted to be controlled by a knob, and wherein each of the said ports communicates with the said second mixing chamber and is adapted to convey a drink into or out of the said second mixing chamber and wherein each of the said ports is adapted to receive a tube detachably coupled thereto; a first tube having two ends wherein the first end is inserted into the first drink container and wherein the second end is coupled to the first port; a second tube having two ends wherein the first end is inserted into the fourth drink container and wherein the second end is coupled to the third port; a third tube having two ends wherein the first end is coupled to the fourth port and wherein the second end of the third tube is coupled to the fifth port; a fourth tube having two ends wherein the first end is inserted into the third drink container and wherein the second end is coupled to the sixth port, the said tube being provided with a check valve inserted therein adapted to prevent drink from flowing into the third drink container; a fifth tube having two ends wherein the first end is inserted into the fourth drink container and wherein the second end of the fifth tube is coupled to the seventh port, the said tube being provided with a check valve inserted therein adapted to prevent drink from flowing into the fourth drink container; a sixth tube having two ends wherein the first end is inserted into the fifth drink container and wherein the second end of the sixth tube is coupled to the eighth port, the said tube being provided with a check valve inserted therein adapted to prevent drink from flowing into the fifth drink container; a seventh tube having two ends wherein the first end is inserted into the sixth drink container and wherein the second end of the seventh tube is coupled to the ninth port, the said tube being provided with a check valve inserted therein adapted to prevent drink from flowing into the sixth drink container; an eighth tube having two ends wherein the first end is coupled to the tenth port and wherein the said tube is routed to the front of the hat and is adapted to be supported by an articulated boom; and a bracket attached to and depending from the hat and having pivotally coupled thereto an articulated boom adapted to support the said eighth tube.

2. A portable bar comprising a hard hat having provided therein head bands adapted to be adjusted to fit different size heads, the said hard hat being adapted to receive a plurality of drink containers and a plurality of valves detachably mounted thereon and having provided therethrough a plurality of holes each of which holes is adapted to receive a tube inserted therethrough, wherein each of the said holes is provided with a protective grommet; a first closable drink container detachably coupled to the said hard hat by suitable attachment means and having provided thereon a cap adapted for closing the said container, the said first drink container being provided with vent means adapted to vent the inside to the said container to the atmosphere and wherein the said first drink container is provided with a hole therethrough having a protective grommet inserted therein, the said hole being adapted to receive a tube inserted therethrough; a second closable drink container detachably coupled to the said hard hat by suitable attachment means and having provided thereon a cap adapted for closing the said container, the said cap having provided therein a vent means adapted to vent the inside to the said container to the atmosphere and having also provided therethrough a hole adapted to receive a tube inserted therethrough and into the said container; a third closable drink container detachably coupled to the said hard hat by suitable attachment means and having provided thereon a cap adapted for closing the said container, the said cap having provided therein a vent means adapted to vent the inside to the said container to the atmosphere and having also provided therethrough a hole adapted to receive a tube inserted therethrough and into the said container; a fourth closable drink container detachably coupled to the said hard hat by suitable attachment means and having provided thereon a cap adapted for closing the said container, the said fourth drink container being provided with vent means adapted to vent the inside to the said container to the atmosphere and wherein the said fourth drink container is provided with a hole therethrough having a protective grommet inserted therein, the said hole being adapted to receive a tube inserted therethrough; a fifth closable drink container detachably coupled to the said hard hat by suitable attachment means and having provided thereon a cap adapted for closing the said container, the said cap having provided therein a vent means adapted to vent the inside to the said container to the atmosphere and having also provided therethrough a hole adapted to receive a tube inserted therethrough and into the said container; a sixth closable drink container detachably coupled to the said hard hat by suitable attachment means and having provided thereon a cap adapted for closing the said container, the said cap having provided therein a vent means adapted to vent the inside to the said container to the atmosphere and having also provided therethrough a hole adapted to receive a tube inserted therethrough and into the said container; a first gang valve detachably coupled to the said hard hat by suitable attachment means, the said gang valve having a first mixing chamber, the said first mixing chamber having extending therefrom a first port, a second port, a third port, and a fourth port wherein the said first port is provided therein with a first valve and the said second port is provided therein with a second valve and the said third port is provided therein with a third valve, and wherein each of the said ports communicates with the said first mixing chamber and is adapted to convey a drink into or out of the said first mixing chamber and wherein the said first, third and fourth ports is each adapted to receive a tube detachably coupled thereto, and wherein the said second port is adapted to vent the said first mixing chamber to the atmosphere; a second gang valve detachably coupled to the said hard hat by suitable attachment means, the said gang valve having a second mixing chamber, the said second mixing chamber having extending therefrom a fifth port, a sixth port, a seventh port, an eighth port, a ninth port and a tenth port wherein the said fifth port is provided therein with a fourth valve and the said sixth port is provided therein with a fifth valve and the said seventh port is provided therein with a sixth valve and the said eighth port is provided therein with a seventh valve and the said ninth port is provided therein with an eighth valve, and wherein each of the said ports communicates with the said second mixing chamber and is adapted to convey a drink into or out of the said second mixing chamber and wherein each of the said ports is adapted to receive a tube detachably coupled thereto; a first tube having two ends wherein the first end of the first tube is inserted into the first drink container through the hole through the container and wherein the second end of the first tube is detachably coupled to the first port; a second tube having two ends wherein the first end of the second tube is inserted into the fourth drink container through the hole through the container and wherein the second end of the second tube is detachably coupled to the third port; a third tube having two ends wherein the first end of the third tube is detachably coupled to the fourth port and wherein the tube is routed into the hat through a first hole in the hat and is routed out of the hat through a second hole in the hat and wherein the second end of the third tube is detachably coupled to the fifth port; a fourth tube having two ends wherein the first end of the fourth tube is inserted into the second drink container through the hole through the cap of the container and wherein the said tube is routed into the hat through a third hole in the hat and is routed out of the hat through a fourth hole in the hat and wherein the second end of the fourth tube is detachably coupled to the sixth port wherein the tube is provided with a check valve inserted therein and adapted to prevent drink from flowing into the second drink container; a fifth tube having two ends wherein the first end of the fifth tube is inserted into the third drink container through the hole through the cap of the container and wherein the said tube is routed into the hat through a fifth hole in the hat and is routed out of the hat through a sixth hole in the hat and wherein the second end of the fifth tube is detachably coupled to the seventh port and wherein the tube is provided with a check valve inserted therein and adapted to prevent drink from flowing into the fourth drink container; a sixth tube having two ends wherein the first end of the sixth tube is inserted into the fifth drink container through the hole through the cap of the container and wherein the said tube is routed into the hat through a seventh hole in the hat and is routed out of the hat through a eighth hole in the hat and wherein the second end of the sixth tube is detachably coupled to the eighth port and wherein the tube is provided with a check valve inserted therein and adapted to prevent drink from flowing into the fifth drink container; a seventh tube having two ends wherein the first end of the seventh tube is inserted into the sixth drink container through the hole through the cap of the container and wherein the said tube is routed into the hat through a ninth hole in the hat and is routed out of the hat through a tenth hole in the hat and wherein the second end of the seventh tube is detachably coupled to the ninth port and wherein the tube is provided with a check valve inserted therein and adapted to prevent drink from flowing into the sixth drink container; an eighth tube having two ends wherein the first end of the said eighth tube is detachably coupled to the tenth port and wherein the said tube is routed into the hat through an eleventh hole in the hat and is routed to the front of the hat and is adapted to be supported by an articulated boom; and a bracket attached to and depending from the hat and having pivotally coupled thereto an articulated boom comprising two sections pivotally joined end-to-end and a mouth piece support member having an opening therethrough, through which the said eighth tube is inserted.

* * * * *